US006497169B1

(12) United States Patent
Khosla

(10) Patent No.: US 6,497,169 B1
(45) Date of Patent: Dec. 24, 2002

(54) METHOD FOR AUTOMATIC WEAPON ALLOCATION AND SCHEDULING AGAINST ATTACKING THREATS

(75) Inventor: Deepak Khosla, Calabasas, CA (US)

(73) Assignee: Raytheon Company, Lexington, MA (US)

( * ) Notice: Subject to any disclaimer, the term of this patent is extended or adjusted under 35 U.S.C. 154(b) by 66 days.

(21) Appl. No.: 09/834,425

(22) Filed: Apr. 13, 2001

(51) Int. Cl.[7] ..... B64D 1/04
(52) U.S. Cl. ..... 89/1.11; 89/41.07; 702/144
(58) Field of Search ..... 89/1.11, 41.07, 89/41.03, 41.01, 41.15, 41.16; 702/144

(56) References Cited

U.S. PATENT DOCUMENTS

| | | | | |
|---|---|---|---|---|
| 5,153,366 A | * | 10/1992 | Lucas | 89/1.11 |
| 5,206,452 A | * | 4/1993 | Stamper et al. | 89/1.11 |
| 5,404,516 A | | 4/1995 | Georgiades | 89/1.11 |
| 5,511,218 A | * | 4/1996 | Castelaz | 89/1.11 |
| 5,682,006 A | * | 10/1997 | Perry et al. | 89/41.07 |
| 5,992,288 A | * | 11/1999 | Barnes | 89/1.11 |

OTHER PUBLICATIONS

G.G. denBroeder, R.E. Ellison, and L. Emerling (1959) "On optimum target assignments," Operations Research, vol. 7, pp. 322–326.

S.M. Matlin (1970) "A review of the literature on the missile allocation problem", Operations Research, vol. 18, pp. 334–373.

P. Abrahams et al (1998) "MAAP: Military Aircraft Allocation Planner", pp. 336–341, Evolutionary Computation Proceedings, 1998. IEEE World Congress on Computational Intelligence, 1998.

E. Wacholder (1989) "A neural network–based optimizaton algorithm for the static weapon–target assignment problem", ORSA Journal on computing, vol. 1, No. 4, 232–246.

G.A. Tagliarini, J.F. Christ, and E.W. Page (1991) "Optimization using Neural networks", IEEE Transactions on computers, vol. 40, No. 12, pp. 1347–1358.

* cited by examiner

*Primary Examiner*—J. Woodrow Eldred
(74) *Attorney, Agent, or Firm*—Leonard A. Alkov; Glenn H. Lenzen, Jr.

(57) ABSTRACT

A system and method for automatic weapon allocation and scheduling of the present invention. The inventive method includes the steps of providing data with respect to threats, weapons, weapon allocation options; weapon allocation rules; and temporally dependent constraints with respect thereto; evaluating the data; and temporally allocating the weapons to the threats automatically in accordance with the evaluation. The invention computes the optimal pairing and the best time to deploy each weapon system against threat(s) it is paired with in arriving at the pairing. This results in an optimal assignment where weapon resource constraints are not exceeded and therefore guarantee availability of sufficient resources for engagement of every threat that is paired with a weapon system.

29 Claims, 4 Drawing Sheets

METHOD FOR AUTOMATIC WEAPON ALLOCATION AND SCHEDULING AGAINST ATTACKING THREATS

BACKGROUND OF THE INVENTION

1. Field of the Invention

The present invention relates to systems and methods for allocating and scheduling resources to satisfy one or more time critical objectives. More specifically, the present invention relates to systems and methods for automatically allocating and scheduling weapon system to threats such that a pre-specified battle-space engagement objective is optimized.

2. Description of the Related Art

Previous approaches for automatically allocating and scheduling defensive weapons against attacking threats to maximize an engagement objective have only addressed the static target-weapon pairing problem which is to determine the optimal allocation of weapon systems to engage threats.

While some of these approaches have used trial-intercept calculations to determine the window of engagement to determine a weapon system's effectiveness against a threat, they do not address the issue of when to deploy the weapon system against the threat in this window. This decision is typically made by the individual weapon systems after threats have been assigned to it by the target-weapon pairing algorithm.

Thus, the previous approaches are based on a sequential two-step decision process. In the first step, the target-weapon pairing algorithm decides on which threat(s) to assign to a weapon system based on their effectiveness measures. In the second step, each weapon system makes its decision about when to deploy and engage threat(s) assigned to it from the first step.

Since the first step did not model the engagement-time resource requirements and temporal constraints of the weapon systems, there is a possibility that this step may have assigned enough threats to a weapon system to overwhelm its time-dependant resources, possibly rendering some of the threats unengageable. For example, certain weapon systems have ground-based sensors that guide the interceptor towards the threat either from launch to impact or during some part of the interceptor's flight (seeker on the interceptor may guide during remaining part of flight). Since the number of such ground-based sensors is limited, a weapon system can only guide a limited number of interceptors at any time. If the number of threats requiring simultaneous guidance exceeds this number, then the weapon system will not be able to engage all its threats. The weapon system may then inform the operator about the situation and the operator may then pass it to another weapon system, possibly resulting in delay and even leaked threats.

This sequential disconnected decision making process has two disadvantages:

(1) since actual weapon resource requirements have not been modeled in the first step, weapon systems may end up being assigned more threats than they can engage, and, (2) consequently, there may be engagement delays and/or leaked threats (sub-optimal engagement).

There are several U.S. patents in the area of automatic weapon assignment against threats. See, for example, U.S. Pat. No. 5,992,288 issued Nov. 30, 1999 to Gregory R. Barnes and entitled Knowledge Based Automatic Threat Evaluation And Weapon Assignment. This patent evaluates threats and based on trial-intercept calculations determines which weapon systems can engage it and ranks them based on their effectiveness in neutralizing a threat. The algorithm selects the best weapon to neutralize the threat. No optimization across the battle-space is provided.

See also U.S. Pat. No. 5,511,218 issued Apr. 23, 1996 to P. Castelaz and entitled Connectionist Architecture For Weapons Assignment; U.S. Pat. No. 5,404,516 issued Apr. 04, 1995 to D. E. Georgiades, P. R. Jensen and T. S. Nichols and entitled System For Allocating Resources And Method; and U.S. Pat. No. 5,153,366 issued Oct. 06, 1992 to T. Lucas and entitled Method For Allocating And Assigning Defensive Weapons Against Attacking Weapons. As discussed before, none of these inventions optimize the deployment or launch time of the weapon system. U.S. Pat. No. 5,404,516 incorporates the temporal dimension in an embodiment that deals with assigning jamming resources to assist in missions attacking enemy assets, where each mission has a predetermined weapon allocation to threat, weapon loading, etc. This assumes that the time of engagement between a threat and weapon (of a mission) is predetermined (i.e., fixed) and the jammer is supposed to be available to jam from this time up to a fixed future time (10 minutes). Each jammer supports a set of missions. While the allocation of jammers to support missions is optimized to maximize an objective function, there is no optimization of the jamming time itself as the start time and duration are fixed. Thus the reference assumes fixed resource allocation and only determines the scheduling of available resources such that no resources overlap in time. In other words, it does allocation and scheduling without optimizing the temporal dimension.

In short, none of these patents address and solve the problem of optimizing "when" to deploy the resources (weapon systems). Some of these approaches use a simple weapon model to perform trial-intercept calculations (battle-space analysis). The weapon model used includes weapon system parameters such as weapon system location, type of interceptor, range of interceptor, etc. that determine if and when the weapon system will be able to engage and intercept a specific threat. All weapon systems that can potentially engage a threat become options for engaging that threat. However, weapon system resource limitations during actual engagement of the threat when multiple threats are assigned to it are not considered. So if a threat can be intercepted by a weapon system based on battle-space calculations, it is assumed that the weapon system will be able to engage and intercept it.

These approaches do not determine whether the weapon system can actually engage the threats if several threats are assigned to this weapon system with each threat individually engagable by the weapon system based on battle-space calculations. For example, if several threats have overlapping intercept time windows and each interceptor needs to be guided during some part of its flight from launch to intercept, then there may not be enough guidance sensors at this weapon system to guide interceptors to engage all threats assigned to it. Thus, every threat may end up being assigned a weapon system in these methods, but every threat may actually not be engaged as its assigned weapon system may not have enough resources at engagement time. As a consequence, they suffer from the disadvantages listed above. Even if engagement time resources are considered in the allocation and scheduling, as in U.S. Pat. No. 5,404,516, optimal engagement objectives cannot be achieved without optimizing the time of allocation (scheduling) of these resources.

Hence, a need remains in the art for a weapon allocation system and method that determines weapon allocation and scheduling to optimize an objective function while simultaneously incorporating and optimizing the temporal dimension.

SUMMARY OF THE INVENTION

The need in the art is addressed by the system and method for automatic weapon allocation and scheduling of the present invention. The inventive method includes the steps of providing data with respect to threats, weapons, weapon allocation options; weapon allocation rules; and temporally dependent constraints with respect thereto; evaluating the data; and temporally allocating the weapons to the threats automatically in accordance with the evaluation.

The current invention computes the optimal pairing and the best time to deploy each weapon system against threat(s) it is paired with in arriving at the pairing. This results in an optimal assignment where weapon resource constraints are not exceeded and therefore guarantee availability of sufficient resources for engagement of every threat that is paired with a weapon system.

The invention overcomes the disadvantages of previous approaches by combining the first and second steps typical of the prior art into a single decision step. Thus, it determines not only which threats to assign to a weapon system but also when to deploy them (launch interceptors) so that a prespecified engagement objective is optimized. This requires modeling the weapon time-dependent resource constraints during the assignment evaluation itself. By calculating the best combination of deployment times as part of the allocation decision itself in evaluating a particular assignment, it can determine whether the assignment would have resulted in a situation where each weapon system would have been able to engage all its threats or not. As a result, it can achieve an optimal assignment where all weapon systems will actually be able to engage threats assigned to them. This will result in effective battle management even under extremely heavy attack situations that seemingly outnumber weapon resources.

However, combination of the two steps introduces temporal dimension optimization into the asset allocation problem causing a combinatorial explosion in the solution space and resulting in a resource-constrained scheduling problem i.e., a Weapon Allocation and Scheduling problem (WASE). This is a far-more computationally expensive problem than the static problem tackled in previous approaches. Since one of the primary objectives is to have a system that runs in close to real time (i.e., update times of at most few seconds), we have developed a fast algorithm to solve the WASE problem. The novel algorithm is a hybrid genetic algorithm that uses a true genetic algorithm and merges it with a simulated-annealing type algorithm. The engagement objective in the genetic algorithm is posed as a function of the deployment times that are optimized by the simulated-annealing type algorithm. Thus, by optimizing the deployment or launch times in this step, the objective function of each trial assignment in the genetic algorithm is optimized. The genetic algorithm then optimizes the engagement objective by searching for the best assignment.

A novel heuristic measure in a temporal optimization algorithm is also disclosed that provides a fast, but approximately optimal solution with significant reduction in the computational cost.

DESCRIPTION OF THE INVENTION

Figure 1:
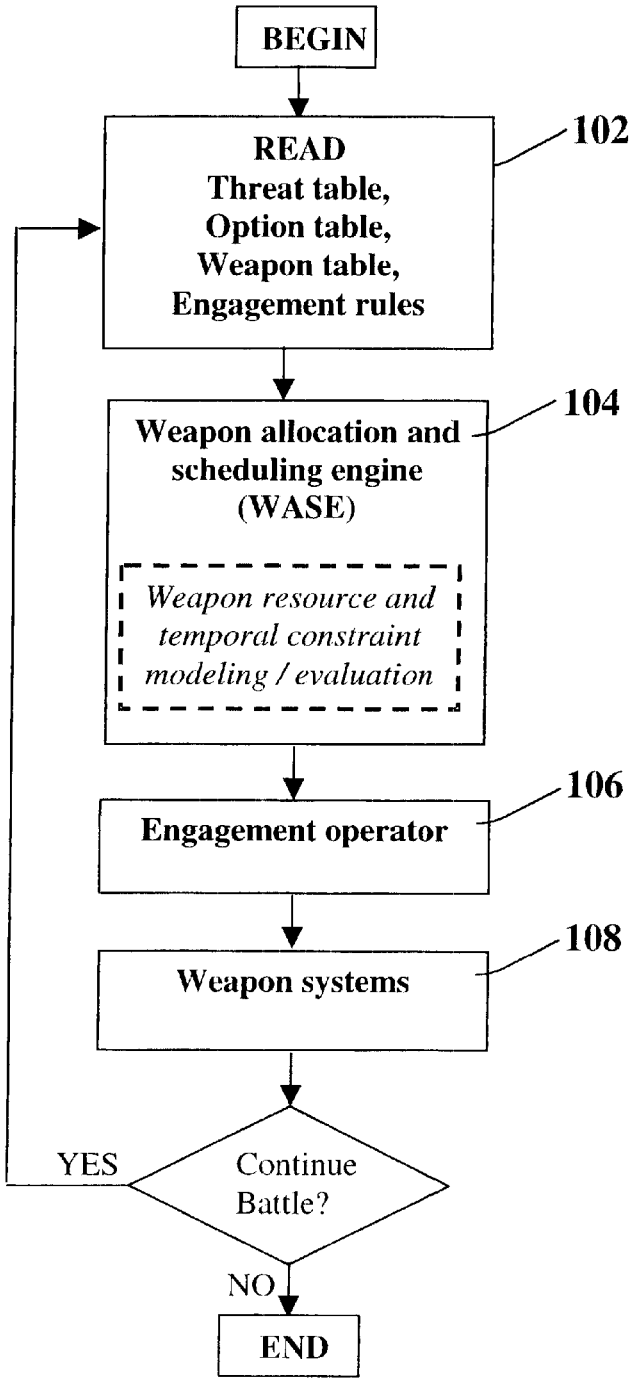
FIG. 1 is a flowchart of an illustrative embodiment of the method of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention describes a method and system for automatically allocating and scheduling defensive weapons against attacking threats to maximize an engagement objective. In a typical battlefield situation at any time, there may be multiple threats headed towards valuable defended assets and multiple weapon systems available to counteract these threats. It is also very likely that more than one weapon system is capable of engaging and neutralizing a given threat. In other words, there may be multiple choices to engage each threat. For one threat and J weapon systems, where each weapon is a potential way to engage this threat, the number of possible target-weapon pairings is J. For two threats and J weapon systems, the Anumber of possible pairings is $J^2$. For I threats and J weapon systems, the number of possible pairings is $J^1$. Thus, as the number of threats increases, the number of such combinations or possible target-weapon pairings increases exponentially.

If the weapon systems were allowed to make their own decisions with respect to deciding which threats to engage, then it is likely that multiple weapon systems may engage the same threat resulting in unnecessary over-utilization of expensive resources. On the other hand, some threats, such as threats heading towards small and non-military defended assets, may go unengaged because none of the weapon systems had enough resources to engage it as they were all engaging the important threats. The net result could be leaked threats and wasted resources.

An effective solution to remedy these problems is network-centric battle management, where a centralized decision-making process allocates specific threats to specific weapon systems. Such schemes usually begin by predicting the destructive effect of the incoming threat against defended assets. Based on the threat's intent and other factors such as time-to-impact, these threats are ranked or assigned a threat value. They also consider the effectiveness of the available weapon systems in neutralizing any given threat which include factors such as threat type and time-to-intercept. Typically these methods project threat trajectory and perform threat-intercept calculations to determine a future time interval when the weapon will be effective in engaging and neutralizing the threat. A typical battle management scheme lists all weapon systems capable of engaging a threat and ranks them based on their effectiveness in neutralizing it. The engagement operator then decides which weapon system to select for a threat based not only on the rank, but additional factors such as weapon inventory and engagement objective. A typical engagement objective is to maximize threats killed or to minimize the value of assets destroyed.

In a battle-space situation with a large number of threats and weapon systems, the engagement operator has to analyze a large number of possible combinations and factors to make the pairing decision. In addition, the battle-space situation may change quickly with new incoming threats and existing threats changing their intent or being destroyed. This may require changes to the previous target-weapon pairing decided by the operator. A specific example is when a high-priority threat appears and the most effective weapon system against it has already been paired with a previous threat. In such a case, changes to the allocation may be required. Thus, the engagement operator may need to analyze many possible pairings under time constraints that could result in delay and poor judgments and decisions. The net result is ineffective battle management that could directly impact the survivability of the defended assets. Thus there is a need for methods that could analyze the vast amount of data and factors to decide the most effective pairing.

Previous methods and systems to automatically assign weapons to threats basically assist in or replace the time-consuming task of manual decision-making. See for example, [1] G. G. denBroeder, R. E. Ellison, and L. Emerling (1959) "On optimum target assignments," *Operations Research,* Vol. 7, pp. 322–326. [2] S. M. Matlin (1970) "A review of the literature on the missile allocation problem", *Operations Research,* vol. 18, pp. 334–373. [3] P. Abrahams et al (1998) "MAAP: Military Aircraft Allocation Planner", pp. 336–341, *Evolutionary Computation Proceedings,* 1998. *IEEE World Congress on Computational Intelligence,* 1998. [4] E. Wacholder (1989) "A neural network-based optimization algorithm for the static weapon-target assignment problem", *ORSA Journal on computing,* Vol. 1, No. 4, 232–246. [5] G. A. Tagliarini, J. F. Christ, and E. W. Page (1991) "Optimization using Neural networks", *IEEE Transactions on computers,* vol. 40, No. 12, pp. 1347–1358.

These methods select the target-weapon pairing that optimizes the engagement objective, such as maximizing the threat neutralized. They could also consider other objectives (such as weapon load balancing, engaging certain high-payoff threats, etc.) and constraints (such as weapon inventory). However, none of these methods consider additional time-dependent resources of the weapon system. In other words, they only address the static target-weapon pairing problem that is to determine the optimal allocation of weapon systems to engage threats.

As mentioned in the Background of the Invention, while some of these approaches have used trial-intercept calculations to determine the window of engagement to determine a weapon system's effectiveness against a threat, they do not address the issue of when to deploy the weapon system against the threat in this window of opportunity. While the desired objective is to engage threats as early as possible, it may not always be possible to do so when there are many simultaneous incoming threats that could overwhelm weapon resources. For example, certain weapon systems have ground-based resources that guide the interceptor towards the threat either from launch to impact or during some part of the interceptor's flight. (The seeker on the interceptor may guide during remaining part.) Since the number of such guidance resources is limited, a weapon system can only guide a limited number of interceptors at any time. If the number of threats requiring simultaneous guidance exceeds this number, then the weapon system will not be able to engage all threats. It may then be necessary to push the time of deployment of interceptors against some threats later in this window. By adjusting the launch time, the number of threats needing simultaneous guidance by the weapon system could be reduced. Thus, some combination of deployment times could be found where the weapon system can handle many more threats than it could if all were engaged early on in their windows.

Current algorithms assign threats to a weapon system based on optimal static allocation objective and leave the decision of when to engage threats up to the weapon system. Thus, they are based on a sequential two-step decision process. In the first step, the algorithm decides on which threat(s) to assign to a weapon system based on their effectiveness measures. In the second step, each weapon system makes its decision about when to deploy and engage threat(s) assigned to it from the first step. Since the first step does not model the engagement-time resource requirements and temporal constraints of the weapon systems, there is a possibility that a weapon system may have been assigned enough threats to overwhelm its time-dependent resources rendering some of the threats unengageable. Though each threat assigned to the weapon system may be individually engageable by the weapon system based on battle-space calculations, the first step does not analyze whether the weapon system can actually engage these threats. Thus, a weapon system could be assigned less or more threats than it could engage. Only when these threats are assigned to the weapon system and it performs its own calculations in the second step on when to engage them is it determined whether or not the weapon will be able to engage all these threats. In such a case, either the weapon system may inform the engagement operator about its incapability to engage some threats that would require a re-allocation or some threats may leak through. Thus, every threat may end up being assigned a weapon system in these methods, but every threat may actually not be engaged as its assigned weapon system may not have enough resources at engagement time.

This sequential disconnected decision making process has two disadvantages (1) Since actual weapon resource requirements have not been modeled in the first step, weapon systems may end up being assigned more threats than they can engage, and (2) Consequently, there may be engagement delays and/or leaked threats (sub-optimal engagement).

An intuitive way to handle this problem is to model guidance resources akin to non-time dependent resources such as weapon interceptor inventory resources (number of interceptors). Note that non-time dependent does not imply that the inventory is static as the battle-space progresses. Instead it refers to the fact that these resources do not depend on the launch time as guidance resources do. However, if we used the approach taken in previous methods with guidance resources as well, this would imply that the maximum number of threats with overlapping intercept windows assigned to a weapon system would be equal to number of guidance sensors.

It is easy to realize that this is not an efficient assignment because even with overlapping windows, many more threats can be engaged by the weapon system depending on when the interceptors are launched. In general, threats can be intercepted by a weapon system over a wide time window. One then has the choice of engaging the threat as soon as possible or sometime later in this window of opportunity.

Since the launch time is dependent on the chosen intercept time, the guidance resource requirement for any threat is time-dependent. Thus, by suitably selecting intercept times for threats, more threats can be potentially engaged by a weapon system then it would be possible if all threats were chosen to be intercepted at the earliest opportunity. In other words, this time analysis could result in better utilization of weapon resources. It could also avoid assignments where more threats than a weapon system can simultaneously handle are passed to it. However, this analysis needs to be performed as part of the allocation algorithm before the threats are assigned to a weapon system.

The present invention does this by modeling engagement resource and temporal constraints of each weapon system during the optimal allocation computation process itself. By doing so, each weapon system is only allocated threats that it can actually engage with maximal utilization of its resources. This is a fundamental aspect of the proposed invention and novel compared to previous automatic target-weapon pairing algorithms. Thus the allocation scheme not only decides which threat to assign to which weapon system, but also calculates when a threat should be engaged by the weapon system it has been paired with. By suitably optimizing the engagement times, one can achieve a much more effective battle management scheme even under extremely heavy attack situations that seemingly outnumber weapon resources.

However, this comes at the expense of a much more difficult mathematical problem. Introduction of the temporal dimension into the asset allocation problem leads to a combinatorial explosion in the solution space and results in a resource-constrained scheduling problem (which can be viewed as an optimization problem as well).

In addition, when time is treated as a continuous variable rather than being divided into finite discrete intervals, the problem becomes a mixed integer problem (both discrete and continuous variables). Inherent complexities in the problem of determining a schedule include limited resources, time windows under which particular activities must occur, and complex interdependencies of various tasks and resources. The number of candidate schedules increases exponentially with the number of threats that need to be engaged. However, many of these candidate schedules may not be feasible in the sense that they violate resource constraints, time window constraints, or other constraints.

That is, the combination of the two steps introduces temporal dimension optimization into the asset allocation problem causing a combinatorial explosion in the solution space and resulting in a resource-constrained scheduling problem. We will henceforth refer to this new problem as the Weapon Allocation and Scheduling problem (WASE).

The WASE problem is the search over the candidate schedules for a schedule that maximizes cost function while satisfying all constraints. From a logical perspective, the WASE problem can be viewed as two optimization problems. The first optimization problem is to pair the threats with weapon systems. Since each threat has a limited number of options (weapon systems) to engage it, this is a discrete optimization problem. Thus, each threat is either assigned a weapon system or not. If it is assigned a weapon system, then the choice is amongst one of the many weapon systems that can engage it. In order to determine if this assignment is feasible, all resource and temporal constraints at each weapon system need to be satisfied. Even with overlapping time windows, it may be possible to find some combination of launch times for which all interceptors can be guided even with the weapon system's limited guidance capacity. This results in the second optimization problem—optimizing the launch time for all threats assigned to a weapon system to determine if constraints are satisfied.

Only if all constraints are satisfied at all weapon systems, does the assignment become feasible. If such a combination of launch times cannot be found for all threats, then it tries to find the combination of launch times for the threat subset with the highest total threat value amongst all other subsets that can be successfully engaged. In other words, this threat subset should not only have maximum total threat value, but corresponding launch times should meet the following exemplary temporal and resource constraints: Temporal constraints are that the actual launch time for the interceptor must be between the earliest and latest launch times. Resource constraints are that 1) the total number of available missiles should be greater than number of threats in the subset and 2) the number of simultaneously guided interceptors (function of launch times) should not exceed its maximum guidance capacity.

Thus the second problem can be posed as a constrained nonlinear dual-optimization problem. Either a threat is chosen or not and for each chosen threat a launch time needs to be calculated such that constraints are not violated. This dual optimization problem is also very complicated and computationally expensive. The assignment with the highest objective function then becomes the optimal assignment. Note that the two problems are coupled in that determining the optimal intercept time effects the assignment scheme. While the deployment times calculated by the algorithm guarantee that weapon resource requirements will not be exceeded (for all weapon resources that have been modeled), the final decision on when to deploy and engage threats may be left to the weapon system.

Thus an objective of this invention is to allocate and schedule defensive resources over a given period of time so as to maximize an engagement objective subject to resource availability constraints as well as temporal constraints. Some important properties of the WASE problem are that it is:

(a) NP-complete (see [6] S. P. Lloyd and H. S. Witsenhausen (1986) "Weapon allocation is NP-complete", *Proc.* 1986 *Summer Comput. Simulation Conf.*) i.e., one must essentially resort to complete enumeration to find the optimal solution;

(b) Mixed-integer, i.e., both discrete and continuous variable (while weapons are either assigned to or not assigned to a target, the time of assignment may be continuous);

(c) Large-scale (the number of weapons and targets is large, making enumeration technique impractical);

(d) Dynamic (not only because time is introduced, but solutions need to be quickly recomputed based on modified engagement rules or changing battle scenarios); and (e) Real-time (solutions must be generated in quick update cycles close to real-time).

Properties (a)–(c) of the problem reduce the likelihood of obtaining algorithms that are both efficient and optimal. Algorithms seeking exact optimal solution to the WASE are impractical because of a combinatorial explosion in the number of possible allocation strategies. Thus approximate (or heuristic) algorithms are needed which can find good solutions with computational efficiency.

Consequently, short of enumerating all possible solutions to the problem (which is totally unfeasible for all but the smallest problem instance), all practical algorithmic solution methods employ heuristics to find good solutions. The present teachings provide an algorithm by merging and modifying simulated annealing (see [7] N. Metropolis, A. Rosenbluth, A. Rosenbluth, M. Teller, E. Teller "Equation of state calculation by fast computing machines", *Journal of Chemical Physics,* 21, pp. 1087–1091, 1953 and [8] S. Kirkpatrick, C. D. Gelatt, and M. P. Vecchi "Optimization by simulated annealing", *Science,* vol. 220, 671–680, 1983) and genetic algorithms (see [9] Goldberg, D. E. (1989). Genetic Algorithms in Search, Optimization, and Machine Learning. Addison-Wesley: Reading, Mass.) both of which are stochastic methods that are simple and robust and can find the global minimum with a high probability.

FIG. 1 is a flowchart of an illustrative embodiment of the method of the present invention. As discussed more fully below, a scheduler engine (WASE) will get its inputs from several tables or other forms of databases and output suitable weapon-target pairings and schedules that meet engagement rules and desired goals.

Step 102—Read Input Tables

The process begins with step 102 with a reading of information about the threats and weapons and engagement rules for the current battle-space. The three primary input tables are:

Threat table

Information about threats will be provided via a threat table. A threat is an entity that is considered to be hostile by the commander and assigned a finite threat value by the threat evaluation module. The present invention does not address how these threat values are computed. However, typically the trackfile and information about defended assets are used to evaluate the danger posed by the incoming threats. The information about incoming threats is usually available in the form of a track-file.

Generally threats are detected by one or more sensors and additionally fused with other data to identify it as friendly or hostile. Track information such as position and velocity is also contained in this track file. Position and values of defended assets is contained in the defended asset table. This information is used to determine the danger of an incoming threat. Typically, the threat trajectory is used to predict its impact point or heading direction. Based on the defended assets in the neighborhood of the predicted impact point, a value is assigned to this threat. Thus, threats headed towards important military assets are assigned a higher threat value. Other factors such as proximity, time-to-impact, type and expected load of the threat is also taken into consideration in deciding a threat value.

Each active threat will be represented by a row in the threat table, where each row will contain the following fields: Threat number, Threat value. The threat number is a unique integer, generally assigned by the sensor that detects and tracks the threats. The threat value will be an integer in the range 0–100, with higher values signifying more damaging threats. High-payoff threats (HPT) are defined as threats with threat values exceeding a pre-determined threshold. Engagement of HPT's could be a high priority in the scheduling process and in some cases enough of a high priority to guarantee an engagement plan for them even at the expense of the overall objective function optimality. Table 1 below lists a typical threat table.

TABLE 1

Exemplary Threat Table

| Threat number | Threat value |
|---|---|
| 11 | 20 |
| 20 | 65 |
| 31 | 80 |
| 42 | 5 |
| 55 | 95 |

Option table

It is assumed that the battle-space analysis will use the trackfile and information about weapon systems to perform trial-intercept calculations to determine which weapon system can engage a threat. A weapon system is basically a weapon platform with multiple launchers and one or more tracking/guidance sensors. The weapon model used includes weapon system parameters such as weapon system location, type of interceptor, range of interceptor, etc. that determine if and when the weapon system will be able to engage and intercept a specific threat. All weapon systems that can potentially engage a threat become options for engaging that threat. It will generate a table that lists capable options/ways to engage each active threat. An option constitutes a weapon system and the corresponding earliest and latest possible intercept time.

Since each intercept time corresponds to a launch-time calculated by the battle-space analysis, it is preferred to store the earliest and latest launch (deployment) times in the option table. Alternatively, intercept times can be stored directly with a look-up table that gives the launch time of an interceptor for every intercept time with a threat. The illustrative embodiment assumes that the launch times will be in the option table. Thus, if the weapon system deploys an interceptor anywhere in this launch time window it will be able to intercept the threat.

In addition, a resource guidance time parameter will also be provided with each option. This parameter indicates the time window beginning at launch time during which the weapon system's ground based sensor needs to guide the interceptor. Note that other time-dependent resource constraints such as weapon reload and slew time can be incorporated in the option table as well.

Each option for a threat is given in one row of the option table and contains the following fields: Threat number, Weapon number, Earliest launch time, Latest launch time, Guidance resource time duration, option weight, Phase. It is expected that all options for a threat will occupy consecutive rows in the option table, though a general table can be sorted to correspond to this format. All options for a threat in the option table meet or exceed a minimum probability of kill ($P_k$) for that threat. This implies that all options for a threat are considered effective against that threat from the scheduler's perspective. However, each option will have a weight (range 0–100), with higher weights signifying more desirable options. These weights are decided based on Commander's preference, e.g., weights may be decided based on probability of kill ($P_k$) or on maximum range of the weapon. Whenever possible, the WASE should choose the option with the highest weight for all threats. Each option will also ahave a phase, which indicates the status of the option in the previous cycle schedule. Phase values could be unscheduled, scheduled, committed or denied. The phase values will be discussed later in this section.

Table 2 below lists a typical option table. Each of the threats has at least one option or weapon system that can effectively engage it. Several threats have multiple options (e.g., Threat number 11 has 3 options, Threat number 42 has 4 options). The earliest and latest launch or deployment time for each option are given in columns 3 and 4. Column 5 gives the guidance resource time window for each option. For example, weapon system 10 can successfully intercept threat number 11 (row 1) if it is deployed anytime between 75 and 95 sec. Column 5 of Table 2 indicates that if the interceptor were launched at any of the launch time between 75 and 95 sec, weapon system 10 would need to commit one of its sensors to guide the interceptor during the first 10 sec of its flight towards threat number 11.

TABLE 2

Exemplary Option Table

| Threat number | Weapon number | Earliest launch time | Latest launch time | Guidance resource duration | Option weight | Phase |
|---|---|---|---|---|---|---|
| 11 | 10 | 75 | 95 | 10 | 10 | Unscheduled |
| 11 | 20 | 48 | 62 | 10 | 20 | Unscheduled |
| 11 | 30 | 50 | 84 | 10 | 30 | Unscheduled |
| 20 | 20 | 105 | 125 | 10 | 50 | Unscheduled |
| 20 | 40 | 100 | 150 | 10 | 30 | Unscheduled |
| 31 | 40 | 80 | 95 | 10 | 30 | Unscheduled |
| 42 | 10 | 10 | 30 | 10 | 20 | Unscheduled |
| 42 | 30 | 15 | 43 | 10 | 10 | Scheduled |
| 42 | 40 | 12 | 35 | 10 | 80 | Unscheduled |
| 42 | 50 | 12 | 40 | 10 | 65 | Unscheduled |
| 55 | 20 | 60 | 90 | 10 | 80 | Commit |

Weapon table

Finally, the weapon system status will be indicated with a set of parameters in the form of a weapon table (see Table 3). This table contains information about the weapon inventory and how many threats are currently being engaged. Weapon systems within the force will not be static. Weapons can move on the battlefield, change inventory information, update operational status at any given time. Parameters for each weapon system will be described in one row of the weapon table, where each row contains the following fields: Weapon number, number of available interceptors, maximum guidance capacity, number of currently guided missiles, {begin time window, end time window}. Note that the {begin time window, end time window} parameters will be given for each interceptor currently being guided by the weapon system. It is assumed in this embodiment that the reload time of a weapon system is zero. Thus, all weapon systems can fire multiple rounds simultaneously.

TABLE 3

Weapon Table example

| Weapon number | Interceptor inventory | Max. guidance capacity | Number currently guided | Begin time-1 | End time-1 | Begin time-2 | End time-2 |
|---|---|---|---|---|---|---|---|
| 10 | 12 | 5 | 0 | | | | |
| 20 | 15 | 5 | 2 | 20 | 30 | 17 | 37 |
| 30 | 3 | 9 | 1 | 12 | 22 | | |
| 40 | 30 | 9 | 0 | | | | |
| 50 | 10 | 9 | 1 | 15 | 35 | | |

Lastly, engagement rules and objective are read from the engagement rule file. This includes information about the allocation strategy (shoot-shoot-look vs. shoot-look-shoot, salvo attack, load balancing), different objectives that need to be met (such as maximize threats neutralized, always engage HPT's), etc. An exemplary objective function is to maximize a weighted sum of threat values (engaged in the allocation selected by WASE) and option weights (of options used to engage threats), where the relative weight a of the threat values is also specified as part of the engagement rules.

Step 104—Weapon Allocation and Scheduling Engine (WASE)

In this module weapon allocation and scheduling is calculated. The algorithm decides whether or not all active threats in the threat table can be engaged some time in the future based on current battle-space conditions and resource usage. If all threats cannot be engaged, it determines the weapon-threat pairing that can engage the subset of threats which maximizes some objective function. The objective function may be based on the engagement rules and objectives read in 102. It could be either a single objective function or multiple objective functions. For example, an engagement objective could be to determine a target-weapon pairing scheme that can engage maximum threat value with highest possible weighted options. The engagement rules and weapon systems used also govern other features and constraints of the problem, such as allocation strategies (shoot-shoot-look vs. shoot-look-shoot, salvo attack, load balancing) and time-dependent resource constraints (weapon reload and slew time, guidance requirements, etc.).

The illustrative embodiment describes a "shoot-look" scheme where only one weapon system is assigned to a threat to engage it at some future time. Those skilled in the art will understand that the proposed invention can be easily extended to handle "shoot-shoot-look" strategies as well.

The illustrative embodiment also assigns or selects only one option or weapon system for each threat (no salvo attack), though multiple threats may be assigned to a single weapon system within the scope of the present invention. Once again the invention can be easily applied to salvo attacks with minor modifications to the objective function within the scope of the present invention.

Finally, the only time-dependent resource modeled in this particular embodiment is the guidance requirements of a weapon system. Other resource constraints can be incorporated in the same framework just as easily within the scope of the present invention.

In order to arrive at the optimal target-weapon pairing, in step 104, the algorithm models the resource and temporal constraints of the weapon system in the allocation algorithm. It uses these constraints to determine the optimal launch times for each threat in the selected threat subset as well. In other words, the algorithm computes the schedule for each weapon system that suggests when each threat should be engaged. This combination of weapon-threat pairing and launch times is the output from the WASE algorithm 104. The output pairing and schedule satisfies all modeled temporal and resource constraints of the battle-space. Temporal constraints modeled in this particular embodiment are that the launch time for engaging the threat by a weapon system must be between the earliest and latest launch times listed in the option table. Resource constraints modeled in this particular embodiment are that 1. total number of threats assigned to each weapon system should not exceed the number of available interceptors at each weapon system (weapon inventory resource) and 2. the number of simultaneously guided interceptors (function of launch times) required to engage threats assigned to each weapon system should not exceed its maximum guidance capacity (weapon guidance resource). The problem and the constraints are described in a mathematical formulation below.

Let L(i,j,k) be a Boolean variable=1 if k denote the launch time for an interceptor from weapon system j to engage threat i, else=0. Note that while number of threats and weapon systems are small finite numbers, the time quantity is a continuous variable starting from the current time to some future time. The time interval in consideration depends on the intercept times of the threats. If several threats are several minutes from being engaged, then those threats may not even be included in the threat and option tables. It is assumed that all threats that belong to the threat table are to be considered in weapon planning and scheduling for the future. Alternatively, the future time interval for which the algorithm should do planning and scheduling can be included as one of the engagement rules. Otherwise, the launch time of an interceptor against the farthest threat in the table determines the length of future time interval. Typically this time interval is broken into discrete numbers with a small step size (chosen as 1 sec in present embodiment). Let us further denote:

| | |
|---|---|
| I | Number of current threats (in threat table) |
| J | Number of current weapon systems (in weapon table) |
| K | Total number of time points in time interval (for which planning is needed) |
| TV(i) | Threat value of threat i |
| OW(i,j) | Option weight of weapon system j for threat i |
| LB(i,j) | Begin launch time for weapon system j for threat i |
| LE(i,j) | End launch time for weapon system j for threat i |
| GT(i,j) | Guidance time interval for interceptor for weapon system j to engage threat i |
| IR(j) | Inventory resource of weapon system j (number of interceptors) |
| GR(j) | Guidance resource capacity of weapon j |

An example engagement objective is to maximize the threat value engaged using the highest possible weighted options for each threat. Note that objective functions to handle secondary damage to incoming threats as well as using multiple weapon systems against the same threat can be easily used in the same framework. These are actually dual objectives, but we have chosen a single objective function as a weighted sum of these objectives. Generally, the threat value term is given a much higher weight and this weighting $\alpha$ could be available as an engagement rule. So, the objective function is to maximize:

$$E = \sum_{i=1}^{I} \sum_{j-1}^{J} \sum_{k=1}^{K} [\alpha TV(i) + (1-\alpha)OW(i, j)]L(i, j, k) \tag{1}$$

subject to the following constraints $$\sum_{j=1}^{J} \sum_{k=1}^{K} L(i, j, k) \le I \forall i \tag{2}$$

$$\sum_{i=1}^{I} \sum_{k=1}^{K} L(i, j, k) \le IR(j) \forall j \tag{3}$$

Constraint (2) is that each threat will be assigned to zero or only one weapon system.

Constraint (3) is that the total number of threats allocated to each weapon system should not exceed its current inventory resource (number of interceptors).

Note that the above constraints do not include the constraint that the maximum number of interceptors being guided at any time should not exceed each weapon system's guidance resource capacity. We can pose this constraint using a new matrix R whose entries are again Boolean and can be completely derived from L as shown below:

$$\text{If } L(i, j, k) = 1, R(i, j, k') = 1 \forall k \le k' \le k + GI(i, j) \tag{4}$$

$$\sum_{i}^{I} \sum_{k}^{K} R(i, j, k) \le GR(j) \forall j \tag{5}$$

As mentioned before, the above assumes that guidance is needed during the first GI(ij) sec after launch for an interceptor from deployed from weapon system j to engage threat i. Other types of guidance requirements will be formulated as a different mathematical constraint, but the same algorithm can be used.

Note that we can add other time-dependent resources such as weapon reload and slew time as multiple constraints in the above framework as well.

In the form that the problem is posed above, the total number of exhaustive possible combinations that satisfy constraint (2) are $(JK)^1$. The number of combinations that satisfy constraint (3)–(5) will be much less during tight-resource conditions.

A naïve solution to the above problem would be to find the optimal L(i,j,k) (i.e., how and when to engage a specific threat) such that objective function (1) is optimized subject to constraints (2)–(5). However, this will require solving a problem with a large search space.

The search space can be reduced by using the fact each weapon system resource constraints (both IR and GR) are independent of other weapon systems. However, to exploit this fact and implement it in an algorithm, the invention reformulates the above resource-constrained scheduling problem and proposes a new two-step approach. In the first step, we ignore the time component and only address the problem of assigning a weapon system to a threat. The number of possible ways of assigning I threats to J weapon systems is $J^1$. This is akin to a static target-weapon allocation problem that is simple combinatorial optimization problem with constraints [1–5].

In the second step, we determine whether the combination or pairing in the first step satisfies all constraints and optimize the launch times such that the highest threat value that can be engaged. If such a combination of launch times cannot be found for all threats, then it tries to find the combination of launch times for the threat subset with the highest total threat value amongst all other subsets that can be successfully engaged. In other words, this threat subset should not only have maximum total threat value, but corresponding launch times should meet the temporal and resource constraints. The optimal launch times computed from the second step determine which of the threats can be engaged and thus effects the value of the objective function. Note that the two steps are not sequential, but the second step is embedded in the first step as it has to be executed for every possible pairing tried in the first step (see step 104 in FIG. 2).

A key aspect of the two-step approach is that we can now solve the time optimization problem for each weapon system independently of all other weapon systems. This approach allows use of the fact that each weapon system resource constraints (both IR and GR) are independent of other weapon systems. The additional advantages of this two-step approach are as follows:

1. It is a natural framework for checking if resource constraints (2) and (3) are satisfied since these constraints are applicable to each weapon system and not correlated across different weapon systems.
2. There may be many launch time combinations that give the optimal solution (all engaged threats) when only considering threats assigned to a specific weapon system. Thus solving the launch time optimization problem separately from the assignment problem (even though one affects the other) reduces the computational cost compared to the naive approach that solves for both in a single step.
3. Lastly it allows us to use different methods for the two steps. We use a genetic algorithm approach for the first step and a simulated annealing type method for the second step.

In spite of the two-step approach, each of the optimization problems will still have a huge search space even for a modest number of threats, weapon systems, and time points. The main complexity comes from the fact that the second step (solving the time optimization problem) has to be performed for each combination analyzed in the first step. Thus, the computational cost of the second step is of prime concern.

In accordance with the present teachings, a novel heuristic method is disclosed athat breaks the second step further into a two-step approach whose solution is approximately close to the solution of the original problem (of the second step), but has a drastically lower computational cost.

The WASE algorithm 104 will be further described in detail below. Module 104 passes its optimal weapon allocation and schedule to the engagement operator 106. One of the novelties of the proposed invention is that the output from the WASE algorithm 104 is simply a new instance of the input option table read in step 102. The only fields altered by the WASE algorithm 104 in the option table are the option phase and begin launch time. The option phase indicates the status the options or weapon systems for each threat. The following phases are used:

Unscheduled

Threat is either new or has not yet been paired with this weapon system (option not selected).

Scheduled

Threat has been paired with a weapon system (option selected) only in the WASE algorithm 104 and presented to 106 but the weapon system 108 has not yet been assigned this threat for future engagement Committed Threat has been committed to a weapon system 108 (option omitted)

Denied

Option has been rejected by the engagement operator 106

Note that only threats that are not yet engaged or killed are listed in the threat table and option table. Thus if the WASE algorithm 104 pairs a threat with one of its weapon systems (options) as part of its optimal allocation and scheduling, then the phase of that option becomes scheduled. The begin launch time value of that option row is changed to the optimized launch time computed by the WASE algorithm 104 as well.

Note that in this embodiment each threat is assigned to either none or only one option (weapon system). Thus, only one option per threat can be in the scheduled or committed phase and all other options will be in the unscheduled or denied phase.

Step 106—Engagement Operator

The role of the engagement operator 106 is to use the allocation and schedule output from the WASE algorithm 104 (modified option table) to determine the time that a weapon system should be committed to its assigned threat(s). The engagement operator 106 may also decide whether or not to accept the assignment. Since the allocation is a plan for the future, several threats may still be a long time away from reaching the engagement zone of the defensive weapons they have been assigned to. For these threats, the operator may simply wait until the launch time approaches and then commit the weapon system to the threat. The engagement operator 106 will take a "wait and see" approach in order to allow flexibility in the schedule. If the threat changes course, a different weapon system may need to be assigned and ultimately tasked. Thus, the engagement operator 106 could wait for some time before committing a weapon system (passing threat number and suggested launch time message to the weapon system).

During this period, the option is in the scheduled phase. After the weapon system has been informed, the option phase is changed to committed. The operator may additionally deny certain weapon assignments in case of changes in engagement rules, weapon status, etc., during the time taken by the WASE algorithm 104 to find the optimal allocation. Thus the option table could have a mixture of unscheduled, scheduled, committed and denied options.

Note that as soon as a weapon system deploys its interceptor to engage a threat, the weapon system informs the source creating the threat table to remove this threat from the threat and table. This threat is not considered active by the WASE 104 and not included in any future planning and scheduling. However, if feedback about a threat status is received and the threat was not neutralized, then it may be put back in the threat table by the source creating the input table. The WASE algorithm 104 will then do the usual planning for this threat (as if it were a new threat). Thus a currently engaged threat will never show up in a threat or option table. However, if an interceptor is currently being guided towards the threat by a weapon sensor, then the guidance resource timings will be included in the weapon table.

Step 108—Weapon Systems

The engagement operator 106 passes commit messages to the individual weapon systems at step 108. The weapon systems then prepare to engage the threats assigned to them. The weapons systems step 108 includes the steps of engaging the threats and updating the weapon table.

Dynamic Scheduling with Minimal Retasking

The method depicted in FIG. 1 is an iterative process that is executed at either a fixed rate or whenever the battle-space situation has changed enough (new threats, change in number of available weapon systems, change in engagement tactics, etc.). When the algorithm is executed, the WASE algorithm 104 needs to keep the previous assignment and schedule in perspective while arriving at or re-planning a new assignment and schedule. One of the key aspects of the invention is in its capability of smart dynamic re-planning with minimal retasking. Minimal retasking implies that the changes to previously planned assignment and schedule will be minimal so as to not cause reassignments and rescheduling on every run that can be both confusing and impractical. The present invention handles this issue by using the option phase field.

Each time re-planning needs to be done, the algorithm starts in step 102 by reading the threat, option and weapon table. As described above, the phase of the option is listed in the option table (see Table 2).

In the first run through the system, all options will be in unscheduled phase. In later runs, if the threat is a new threat or it has not been paired with any weapon, then all of its options will have an unscheduled phase. If an option was selected in the previous run (by WASE) and the engagement operator did not commit it (as launch time was too far into the future), then the option phase will stay scheduled (106 will not change it). However, the battle-space analysis module will be allowed to re-compute the intercept time windows and change the begin and launch time values in creating the option table. If the engagement operator commits an option, then the phase of the option will be changed to commit. In this case, the battle-space analysis module will not re-compute or change the launch time fields in the option table for this option.

Similarly, if the engagement operator 106 denies this option, then the phase will be changed to denied. The WASE algorithm 104 will use the option phase to determine the re-planning algorithm based on the engagement rules and commander's guidance. An example of the engagement rules could be as follows:

Scheduled options can be re-planned (changed to unscheduled) if a better objective can be attained. Thus, if new threats have appeared and the overall engagement objective can be optimized by reassigning weapons previously scheduled for older threats to new threats, then re-planning is allowed. In other words, if an option is scheduled for a threat, then that threat can be either not assigned any weapon (all options unscheduled) or assigned to a new weapon (different option scheduled) in the new schedule generated by the WASE algorithm 104. Thus, scheduled options are treated akin to unscheduled options from a re-planning perspective.

Committed options cannot be re-planned, unless specified differently in the engagement rules. When an option is committed, it implies that the operator informed the weapon system to engage the threat and that the weapon system is preparing to engage it. Generally, once a weapon system has been committed to a threat, it should be allowed to go ahead unless extreme conditions arise (specified as an engagement rule). An example of such a condition is if an existing or a new threat becomes a high-payoff threat (HPT) and this weapon system is the only one that can effectively engage and neutralize it. Also if the weapon system goes ahead with its current engagement plan, it will not have enough resources to engage the HPT. In such a case, changing the engagement decision by this weapon system may be the only way to be able to engage the HPT. The re-planning algorithm in step 104 handles this situation automatically based on the engagement rules. If it determines that the objective function (hard constraint to engage all HPT's and maximize threat value of all other threats) is maximized with a new allocation and schedule where the commit option is changed (to unscheduled) and the HPT option is scheduled, then it will choose this re-planning. Note that while the commit option has been unscheduled making the weapon stop its preparation for engaging the threat, the new allocation may have still scheduled an alternate option for this threat. Denied options will not be included in any further allocation and scheduling.

Thus, the dynamic scheduling is carried out based on the option phase of all threats, previous schedule, and engagement rules. One way to perform minimal retasking is to assign extra weight to options that are in the scheduled phase. Additionally these options are always present in the initialized trial option configuration population chosen by the genetic algorithm as discussed more fully below. These factors result in a much higher probability that the previous assignment is maintained in the current assignment as well, unless a new assignment with an improved objective function is found.

Step 104—Weapon Allocation and Scheduling Engine (WASE)

Figure 2:
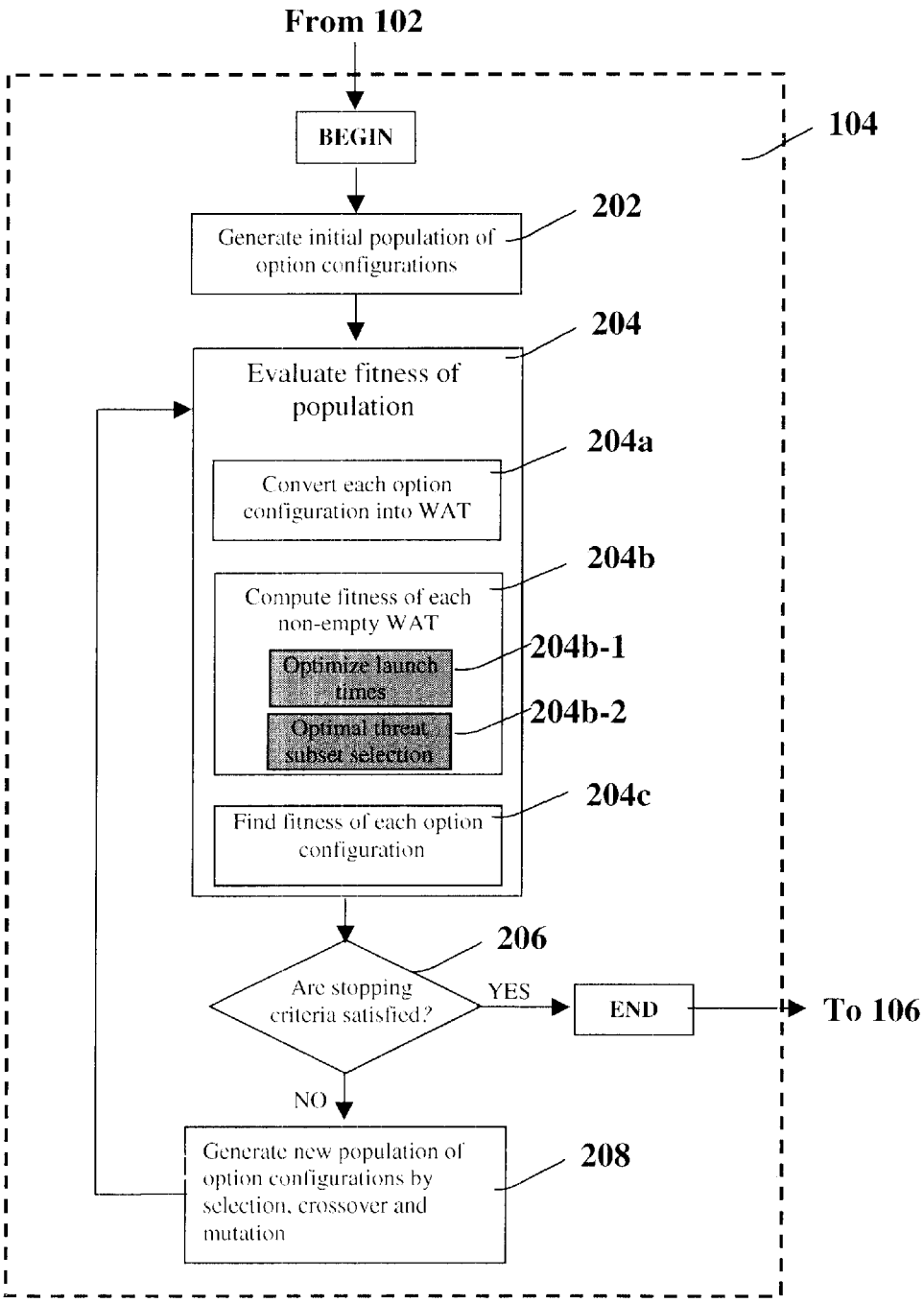
FIG. 2 is a flow diagram of the weapon allocation and scheduling method of the present invention in detail.

FIG. 2 is a flow diagram of the WASE algorithm in detail. As described above, the algorithm is a two-step algorithm where the second step is embedded in and implemented for every trial pairing of the first step. Both steps use a fast heuristic algorithm to arrive at an approximately optimal solution. A brute-force approach of evaluating the objective function of every possible assignment is impossible since the number increases exponentially with the number of threats and weapon systems. In order to arrive at an optimal or close-to-optimal solution in the allowed time (typically a few seconds), a hybrid genetic algorithm is provided for the first step. A genetic algorithm is used because of its simplicity of implementation and robustness. Those skilled in the art will realize that other combinatorial algorithms may be used in place of the genetic algorithm. All of these algorithms will require determining the value of the objective function for a set of trial combinations and constraint checking. The value of objective function will not only be determined by which weapon system is paired with which threat, but also by the launch time. Thus, launch times need to be optimized to find the maximum objective function value and satisfy all constraints. This optimization is done in the second step by a novel simulated annealing type algorithm. Since a simulated annealing type algorithm is embedded in a genetic algorithm, the overall algorithm is called a hybrid genetic algorithm.

Genetic algorithms (GA) are search methods that heuristically 'mimic' biological evolution (namely, the process of natural selection and the 'survival of the fittest' principle). They apply an adaptive search procedure based on a 'population' of candidate solution points. An individual stands for a point of the search space and is associated with a fitness. In the current context, an individual is an option configuration (see below) and a population is a collection of option configurations. The algorithm iteratively builds new generations of populations that evolve through selection, crossover and mutation. Selection favors high fitness individuals whereas crossover and mutation ensure an efficient exploration of search space. Each iteration involves a competitive selection that drops the poorer solutions. The candidates with higher 'fitness' are then 'recombined' with other solutions by swapping components with another; they can also be 'mutated' by making a small change to a single component of a candidate. The recombination and mutation moves are applied sequentially, to generate new solutions that are biased towards regions of the space for which good (though not necessarily globally optimized) solutions have already been found.

Step 202—Generate Initial Population of Option Configurations

The algorithm begins with a step 202 of creating an initial population of option configurations. This is basically the first step of the genetic algorithm that creates a population of candidate solutions from the search space. An option configuration is defined as a table that contains one and only one option (from the option table) for each threat. Let us assume a total of I threats numbered as i=1, 2, 3 . . . I. In the example Table 1, we have I=5 threats. Each threat can be engaged in a finite number of ways or options. We denote the number of options for each threat by $N_i$, where $N_i$ is a finite positive integer. In Table 2, $N_i$=3, $N_2$=2, $N_3$=1, $N_4$=4, $N_5$=1. The total number of option configurations for the above problem size is $N_1 \times N_2 \ldots \times N_I$=24. Table 4 gives an example option configuration formed by randomly picking one option (row) for each threat from Table 2.

TABLE 4

Option configuration example

| Threat number | Weapon number | Earliest launch time | Latest launch time | Guidance resource duration | Option weight | Phase |
|---|---|---|---|---|---|---|
| 11 | 30 | 50 | 84 | 10 | 30 | Unscheduled |
| 20 | 20 | 105 | 125 | 10 | 50 | Unscheduled |
| 31 | 40 | 80 | 95 | 10 | 30 | Unscheduled |
| 42 | 30 | 15 | 43 | 10 | 10 | Scheduled |
| 55 | 20 | 60 | 90 | 10 | 80 | Commit |

In order to code an option configuration (OC) as a chromosome or an individual of the population, we use a very simple notation. If we choose option number k for threat i (1≦k≦ number of options for threat i in option table),, then we code its gene as k. We similarly code genes for all threats based on the option number selected in the OC. The string of genes of length equal to the number of threats then represents the OC. The invention always includes two non-random OC in this initialization step, while the remaining are chosen randomly. The two non-random OC are:

1. An OC that is based on choosing the option with the highest option weight for all threats.
2. An OC that is based on choosing the scheduled or commit options for all threats (Note that only one option per threat may be in either of these phases)

Step 204—Evaluate Fitness of Population of OC

The fitness of population is simply the fitness of each option configuration (OC) in the population. The fitness of each OC is dependent on which threats can be engaged by its chosen weapon system(s) in the OC and the option weights of these weapon systems. We define the fitness of an OC as the weighted sum of two measures (1) Sum of threat values of all engageable threats (SOT), and (2) Sum of Option Weights of the options of these engageable threats in this OC (SOW). If all threats can be engaged (to be determined based on optimizing launch times and determining if combinations of launch times for which no resources constraints are violated can be found), then SOT is simply the sum of threat values of all threats. For example, if all threats are determined to be engageable then SOT for the OC in Table 4 is 265 and it's SOW is 200. The fitness of the OC can be denoted as $\alpha$*SOT+(1−$\alpha$)*SOW, where $\alpha$ is a parameter that could be listed as an engagement rule. For $\alpha$=0.95, if constraint satisfying launch times for each weapon system against all its threats can be found (i.e., all threats are engageable), the fitness of above OC=261.75. However, the launch times need to be optimized before this can be determined. In order to determine the fitness of the OC, it is easy to organize threats in the OC by weapon systems and solve the problem separately for each weapon system. Steps 204*a,* 204*b,* and 204*c* are performed for each OC of the population.

Step 204*a*—Converting OC to Weapon Assignment Tables (WAT)

Since an option for a threat is essentially a way to engage that threat by a specific weapon system, an OC can be translated into a weapon assignment table (WAT). A WAT for each weapon system lists the threats assigned to it for a specific OC. In the above example OC (Table 4), the weapon assignment table for weapon numbers 10 and 50 are empty since no option with these systems appears in the OC. The WAT for weapon systems 20, 30, 40 are not empty and given below:

TABLE 5

Weapon assignment Tables for OC in Table 4

| Threat number | Earliest launch time | Latest launch time | Guidance resource duration | Option weight | Phase |
|---|---|---|---|---|---|
| | | WAT for weapon system 20 | | | |
| 20 | 105 | 125 | 10 | 50 | Unscheduled |
| 55 | 60 | 90 | 10 | 80 | Committed |
| | | WAT for weapon system 30 | | | |
| 11 | 50 | 84 | 10 | 30 | Unscheduled |
| 42 | 15 | 43 | 10 | 10 | Scheduled |
| | | WAT for weapon system 40 | | | |
| 31 | 80 | 95 | 10 | 30 | Unscheduled |

Step 204*b*—Determining Fitness of WAT

The problem of determining whether all or which subset of threats can be engaged for an OC is now translated into determining the same for each WAT. This is a much more direct problem as temporal and resource constraints need to be analyzed for each weapon system independent of other weapon systems. We define a new measure "fitness of WAT" as the total threat value of a WAT that can be engaged without violating any constraints. Step 204*b* is performed for each non-empty WAT of each option configuration in the population. The output from this module is not only the fitness of the WAT, but also a list of threats that can be engaged and the corresponding launch times. The sum of the fitness of all non-empty WAT's then becomes the sum of threat values of all engageable threats (SOT) for the OC (computed in step 204*c*).

For each WAT, it may be possible to find some combination of launch times for which all threats can be engaged even with the weapon system's limited guidance capacity. If such a combination of launch times can be found, then the weapon system can be assigned all threats in its WAT and the WAT has maximum possible fitness (equal to the sum of threat value of all threats in the problem). If such a combination of launch times cannot be found for all threats, then it tries to find the combination of launch times for the threat subset with the highest total threat value (or another objective function) amongst all other subsets that can be successfully engaged (satisfies constraints). Thus, for each WAT, either a threat is chosen or not and for each chosen threat a launch time needs to be calculated such that (1) launch time is in the launch time window and (2) guidance constraints are not violated. In other words, this threat subset should not only have maximum total threat value, but corresponding launch times should meet temporal and resource constraints. This is a constrained dual optimization problem and we tackle it by using a novel simulated annealing-type algorithm that approximates the problem by a single optimization problem followed by a simple sorting step. The approximation is close to the solution of the original problem because of novel heuristics used in the sorting step.

In the first step (step 204*b*-1), we determine launch times for all targets such that the number of resource constraint violations is minimized. Resource constraint violation is defined as one where the number of simultaneously guided interceptors exceeds the guidance capacity of the weapon system. This is a continuous constrained nonlinear optimization problem where the goal is to optimize launch time for threats and the objective function is to minimize the number of resource violations. The number of variables (launch times) to optimize is equal to the number of threats in the WAT.

Since the objective function cannot be expressed as a linear function of the launch times, it is a nonlinear problem. Determining the objective function requires determining the number of violations at each time. While we have several ways to optimize the launch times, we have chosen a simulated annealing-type algorithm to perform this optimization in this embodiment. A simple gradient-descent method (Newton-type) or a non-gradient method (nonlinear simplex) for optimization is susceptible to the local minima problem that can be avoided by using the simulated annealing method. Simulated annealing is a heuristic algorithm based upon the physical analogy of cooling crystal structures which spontaneously attempt to arrive at a stable (globally or locally minimal potential energy) equilibrium configuration. Metropolis et al. [7] first introduced the concept; Kirkpatrick et al. [8] first studied it for optimization models. Simulated annealing is based on random evaluations of the objective function in such a way that transitions out of local minima are possible. Thus it relies on a neighborhood structure and a decreasing cost function to find a minimum. Specifically, local minima are avoided by using cost increasing transitions with a nonzero probability that avoids converging to local minima solutions. The acceptance of such transitions is judiciously controlled by a parameter called temperature, whose idea stems from the physical annealing process.

In the current implementation, the basic idea behind simulated annealing is that instead of only selecting launch times that reduce resource violations, launch times that increase violations are sometimes accepted to prevent the search from getting trapped in local minima. The probability of acceptance is dependent upon a parameter called the temperature that is lowered as the algorithm proceeds. In its original form, the simulated annealing method is provably convergent (in a probabilistic sense) but exceedingly slow; we have used an ad hoc enhancement that makes it much faster. The algorithm chooses randomly a threat that is involved in an unsatisfied constraint, e.g., contributes to exceeding guidance resources at any time. It then randomly picks a new launch time for this threat with probability p. Even if the number of resource violations increases with the new launch time value, it is still chosen, However, with probability 1−p, it picks a new launch time which reduces the number of violated constraints (breaks ties randomly). If no such value exists, it picks a launch time value randomly that does not increase the number of violated constraints. The algorithm is controlled by the probability p. Initially p is set to a high value to allow the search space to be explored and as the algorithm progress, it is reduced to make the search more localized.

Figure 3:
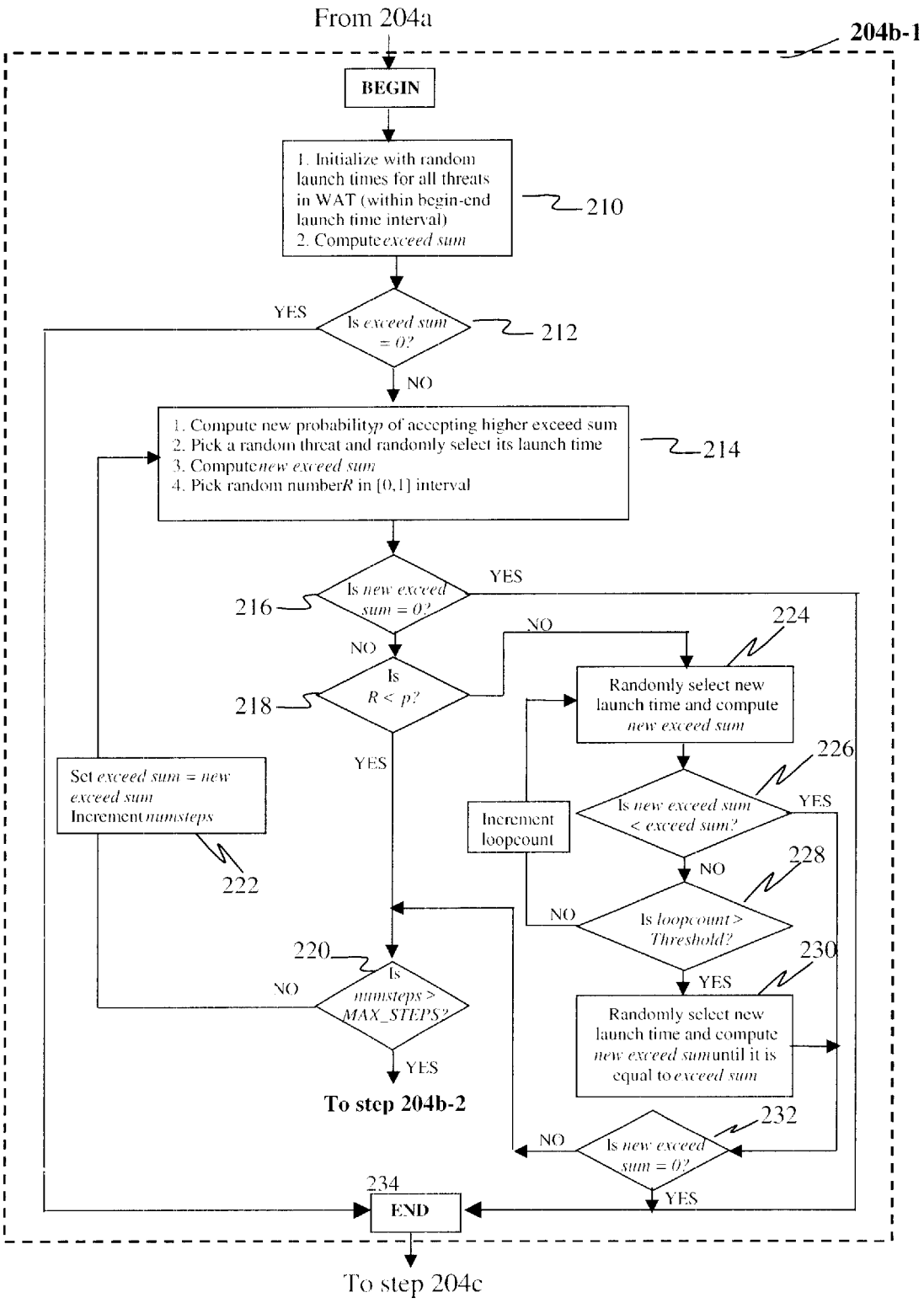
FIG. 3 is a flowchart of an illustrative embodiment of a method for computing the fitness of each non-empty WAT in accordance with the teachings of the present invention.

FIG. 3 is a flowchart of an illustrative embodiment of a method for computing the fitness of each non-empty WAT in accordance with the teachings of the present invention. The method includes the following steps:

Step 210 Choose a random launch time LTwithin the [begin, end] launch time window for each threat in the WAT. Choose an initial value of acceptance probability p. Compute exceed_sum or the total number of resource constraint violations for the WAT. This is done as follows:

a. Determine the end of guidance time GT for each threat (=launch time+guidance interval of the threat—column 4 of Table 6)

b. Based on the LT and GT of each threat, determine total number guided at each time. This is best done by sorting all times (LT and GT for all threats) and only determining number guided at each time. If WAT has N threats, then we have a sorted list of 2N time values. If we take any 2 consecutive time values in this sorted list, then the number being guided during the time interval between these values is constant. Thus, we only need to calculate number guided at 2N−1 time values.

c. Subtract weapon maximum guidance capacity from the number guided in each interval.

d. If difference >0, weapon resources are being exceeded at these intervals. Sum this difference in all such intervals. This gives the total number of resource constraint violations (denoted by exceed_sum in the flowchart).

Note that if this weapon system is already guiding interceptors towards some previous threats (available from weapon table), then the guidance requirements of these threats must be included in the calculations here because they will effect the guidance sensors available for other threats.

Step 212 exceed_sum is compared to zero. If exceed_sum =0, all threats can be engaged and go to END, else continue (launch times need to be optimized until we can reduce exceed_sum)

Step 214 Select randomly a threat from WAT and a launch time (within interval). Also select a random number R in [0,1]. Compute new probability p by multiplying current p with multiplication factor M. Compute new exceed_sum.

Step 216 new exceed_sum is compared to zero. If new exceed_sum =0, all threats can be engaged and go to END, else continue Step 218 If R≦p, accept the new launch time irrespective of whether the number of resource violations is increased or decreased and go to step 220. If R>p, execute steps 224 through 232 (randomly select new launch times for this threat until exceed_sum is lowered or number of steps loopcount exceeds a threshold number of steps. If cannot find a launch time that reduces exceed_sum, then find a launch time that gives an equal value. If exceed_sum=0, go to END else go to step 220)

Step 220 If number of iterations of step 214 numsteps<threshold, lower the probability of acceptance p and continue from step 214, else go to step 204*b*-2.

END (Step 234) Return threat number and launch times of all remaining threats in each WAT. Also return fitness of each WAT which is sum of threat values of all remaining threats.

Step 204*b*-2 Select Highest Threat Value Sum Subset That Meets All Constraints The final solution must not have any resource constraint violations (exceed_sum must be 0). Thus, since exceed_ sum>0 from step 220, then all the threats in the WAT cannot be engaged by this weapon system.

Figure 4:
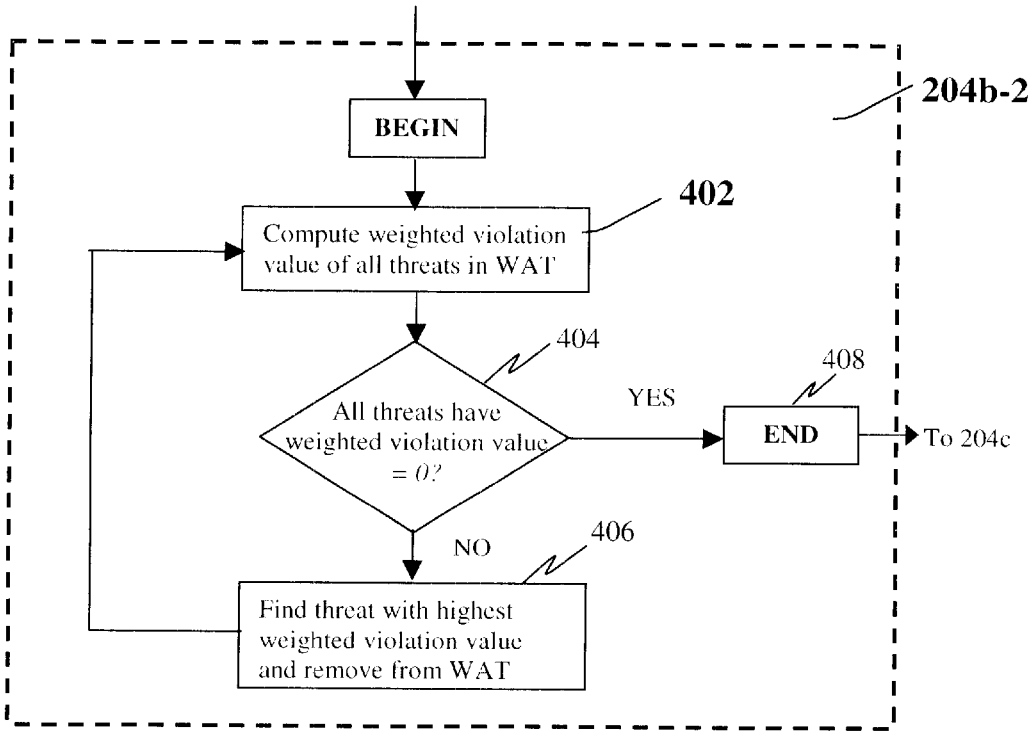
FIG. 4 is a flow diagram of an illustrative embodiment of a method for selecting the highest threat subsets that meet all constraints in accordance with the teachings of the present invention.

FIG. 4 is a flow diagram of an illustrative embodiment of a method for selecting the highest threat subsets that meet all constraints (step 204*b*-2 of FIG. 2) in accordance with the teachings of the present invention. As shown in FIG. 4, the goal of step 204*b*-2 is to determine which threats to eliminate such that the number of remaining threats (threat subset) do not exceed guidance capacity and have a total threat value which is greater than any other combination of remaining threats. While this is really also an optimization problem, we have formulated the problem as a sorting problem by developing a novel heuristic based on both the threat value and number of resource violations due to a threat as a criterion in determining the maximal-threat value subset. This heuristic provides a fast solution to the otherwise computationally expensive optimization problem. The heuristic is based on the observation that the objective of this step can be best achieved by removing those threats that have lower threat values and higher contributions to violating guidance resource constraints. We define a new measure called weighted violation value (WVV) of a threat, which is computed in step 402 as follows:

a. Determine the end of guidance time GT for each threat (=launch time+guidance interval of the threat). Note that if this weapon system is already guiding interceptors towards some previous threats (available from weapon table), then the guidance requirements of these threats must be included in the calculations here because they will effect the guidance sensors available for other threats.
b. Based on the LT and GT of each threat (including currently guided threats), determine total number guided at each time. This is best done by sorting all times (LT and GT for all threats) and only determining number guided at each time. If N threats, then we have a sorted list of 2N time values. If we take any 2 consecutive time values in this sorted list, then the number being guided during the time interval between these values is constant. Thus, we only need to calculate number guided at 2N−1 time values.
c. Subtract weapon maximum guidance capacity from the number guided in each interval.
d. If difference>0, weapon resources are being exceeded at these intervals. Subtract the number of interceptors already being guided in these intervals from this difference to determine violations due to unengaged threats only. We call this violation value of the interval.
e. For all time intervals with violation value>0, find number of threats requiring guidance in each time interval and compute average violation value by dividing violation value by this number.
f. Find threat violation value by summing average violation values of all intervals where it requires guidance. Note that a threat has high threat violation value not simply based on its contribution to violating resource constraints, but also based on the number of other threats that contribute to violating resource constraints as well.
g. Weighted violation value (WVV) of a threat is ratio of threat violation value and threat value. Thus threats which contribute to violating resource constraints and have low threat values have higher WVV.

The algorithm 204*b*-2 proceeds as follows:

Step 402 Compute the WVV of all threats.

Step 404 If all threats have WVV=0, go to END (step 204*c*), else go to step 406.

Step 406 Remove the threat with the highest WVV and go to step 402.

Earlier we defined the fitness of an OC as the weighted sum of two measures (1) Sum of threat values of all engageable threats (SOT), and (2) Sum of Option Weights of the options of these engageable threats in this OC (SOW). Note that the output from step 204*b* is the fitness of each WAT. The SOT value of an OC is then simply the sum of the fitness from step 204*b* of all WAT. The SOW is the sum of option weights of all threats remaining in each WAT. The fitness of an OC is then calculated by a weighted sum of SOT and SOW as $\alpha$*SOT+(1−$\alpha$)*SOW, where $\alpha$ is a parameter that could be listed as an engagement rule. This procedure is performed for each OC in the population.

Step 206—Algorithm Termination

The algorithm is terminated when a predetermined number of cycles have been completed or if the run time has exceeded a fixed time set by the battle-space commander (or by engagement rules) or if the solution returned has the highest possible fitness value for the current battle-space. The fixed time criterion results in a Just-in-Time (JIT) solution that may be sub-optimal, but is the best solution computed up to that time.

Step 208—Generating New Populations

This step is performed using the conventional genetic algorithm operators, i.e., selection, crossover and mutation. Selection copies an individual from the old population to the new population depending on the fitness of the individual. Higher the fitness, the higher is the probability that the individual will survive in the new population. Crossover is a mating process where a new individual is created by mating two individuals from the old population. Mutation randomly alters the value of a gene in the individual. In this case, it amounts to randomly picking a new option for the threat represented by that gene position. The fitness of the new population is then evaluated in step 204 and the process repeats until termination conditions are met.

The output from step 104 is the modified option table which shows the selected option (weapon system) for each threat by its phase field (scheduled or committed) and the corresponding optimized launch time.

Nominal values are below:

| | |
|---|---|
| Size of population in step 202 | 20 |
| Number of cycles of step 204–208 in step 104 | 5 |
| Probability of crossover in step 208 | 0.8 |
| Probability of mutation in step 208 | 0.15 |
| Initial probability of acceptance in step 210 | 0.5 |
| Threshold of numsteps MAX_STEPS in step 220 | 20*Number of threats in WAT |
| Threshold for loop-count MAX_COUNT in step 228 | 20 |
| Multiplication factor M for lowering p in step 214 | exp((log(0.01)/MAX_STEPS)) |

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A method for automatic weapon allocation and scheduling including the steps of:

providing data with respect to threats, weapons, weapon allocation options; weapon allocation rules; and temporally dependent constraints with respect thereto;

evaluating the data; and temporally allocating the weapons to the threats automatically in accordance with the evaluation.

2. The invention of claim 1 further including the step of scheduling the weapons in accordance with the temporal allocation.

3. The invention of claim 1 wherein the step of providing data includes the step of providing data models.

4. The invention of claim 3 wherein the step of providing data models includes the step of providing a table of resource allocation opportunities.

5. The invention of claim 3 wherein the step of providing data models includes the step of providing a resource availability table.

6. The invention of claim 3 wherein the step of providing data models includes the step of providing a set of resource allocation rules.

7. The invention of claim 1 wherein the step of temporally allocating further includes the step of running a weapon allocation and scheduling engine.

8. The invention of claim 1 wherein the step of temporally allocating further includes the step of generating an initial population of option configurations.

9. The invention of claim 8 wherein the step of temporally allocating further includes the step of evaluating a fitness of the initial population.

10. The invention of claim 9 wherein the step of evaluating a fitness of the initial population includes the step of converting each option configuration into a weapon assignment table.

11. The invention of claim 10 wherein the step of evaluating a fitness of the initial population includes the step of computing a fitness of each non-empty weapon assignment table.

12. The invention of claim 11 wherein the step of computing a fitness of each non-empty assignment table includes the step of optimizing a launch time for a given weapon.

13. The invention of claim 12 wherein the step of computing a fitness of each non-empty assignment table includes the step of optimizing launch times for threats in the table and determining the optimal threat subset selection.

14. The invention of claim 10 wherein the step of evaluating a fitness of the initial population includes the step of finding a fitness of each option configuration.

15. The invention of claim 9 wherein the step of temporally allocating further includes the step of comparing the fitness of the population to a stopping criteria.

16. The invention of claim 15 further including the step of scheduling the weapons in accordance with the temporal allocation.

17. The invention of claim 16 further including the step of passing the schedule to an engagement operator if the stopping criteria is met.

18. A method for automatic weapon allocation and scheduling including the steps of:

providing data models with respect to threats, weapons, weapon allocation options; weapon allocation rules; and temporally dependent constraints with respect thereto;

evaluating the models;

temporally allocating the weapons to the threats automatically in accordance with the evaluation, the step of temporally allocating further including the steps of:

generating an initial population of option configurations, evaluating a fitness of the initial population, converting each option configuration into a weapon assignment table, and computing a fitness of each non-empty weapon assignment table, the step of computing a fitness of each non-empty assignment table includes the step of optimizing a launch time for a given weapon; and scheduling the weapons in accordance with the temporal allocation.

19. The invention of claim 18 wherein the step of computing a fitness of each non-empty assignment table includes the step of optimizing a launch time for a given weapon and a given threat subset selection.

20. The invention of claim 18 wherein the step of evaluating a fitness of the initial population includes the step of finding a fitness of each option configuration.

21. The invention of claim 18 wherein the step of temporally allocating further includes the step of comparing the fitness of the population to a stopping criteria.

22. The invention of claim 21 further including the step of generating a new population of option configurations if the criteria is not met.

23. The invention of claim 22 further including the step of scheduling the weapons in accordance with the temporal allocation.

24. The invention of claim 23 further including the step of passing the schedule to an engagement operator if the stopping criteria is met.

25. The invention of claim 18 wherein the step of providing data models includes the step of providing a table of resource allocation opportunities.

26. The invention of claim 18 wherein the step of providing data models includes the step of providing a resource availability table.

27. The invention of claim 18 wherein the step of providing data models includes the step of providing a table of resource allocation options.

28. The invention of claim 18 wherein the step of providing data models includes the step of providing a set of resource allocation rules.

29. A system for automatic weapon allocation and scheduling including:

means for providing data with respect to threats, weapons, weapon allocation options; weapon allocation rules; and temporally dependent constraints with respect thereto;

means for evaluating the data; and means for temporally allocating the weapons to the threats automatically in accordance with the evaluation.

* * * * *